United States Patent [19]

Landa

[11] Patent Number: 4,460,667

[45] Date of Patent: Jul. 17, 1984

[54] METHOD FOR DEVELOPING LATENT ELECTROSTATIC IMAGES FOR GAP TRANSFER TO A CARRIER SHEET

[75] Inventor: Benzion Landa, Edmonton, Canada

[73] Assignee: Savin Corporation, Stamford, Conn.

[21] Appl. No.: 433,665

[22] Filed: Oct. 12, 1982

Related U.S. Application Data

[62] Division of Ser. No. 267,465, May 27, 1981.

[51] Int. Cl.[3] ..... G03G 13/10

[52] U.S. Cl. ..... 430/30; 430/117; 430/119; 355/10; 118/262

[58] Field of Search ..... 430/117, 118, 119, 30; 355/10

[56] References Cited

FOREIGN PATENT DOCUMENTS 682502 3/1964 Canada ..... 430/112

*Primary Examiner*—John D. Welsh

*Attorney, Agent, or Firm*—Shenier & O'Connor

[57] ABSTRACT

This invention relates to a composition for developing latent electrostatic images by liquid development and a method of transferring the developed image to a carrier sheet over a gap. The gap is formed by dielectric spacing particles disseminated through a dielectric carrier liquid, through which toner particles are also disseminated. The toner particles and the spacing particles bear the same surface charge so as to repel each other while in the developing liquid. Apparatus is provided, for use of the novel developing composition, which includes a metering means adapted to remove excess liquid from the surface of a developed image. In order to induce the spacing particles to migrate toward the photoconductor, the metering means is biased to a potential greater than that of the non-image areas. This enables the spacing particles, which have a higher dielectric constant than the carrier liquid, to migrate toward the photoconductor. The toner particles, however, will be attracted to the metering means from the background areas so as to maintain these clear of toner particles. The method contemplates the steps of biasing the metering means with a potential of opposite polarity to the polarity of the toner particles and yet permitting the spacing particles to remain on the photoconductor to perform their spacing function at the gap transfer station.

1 Claim, 1 Drawing Figure

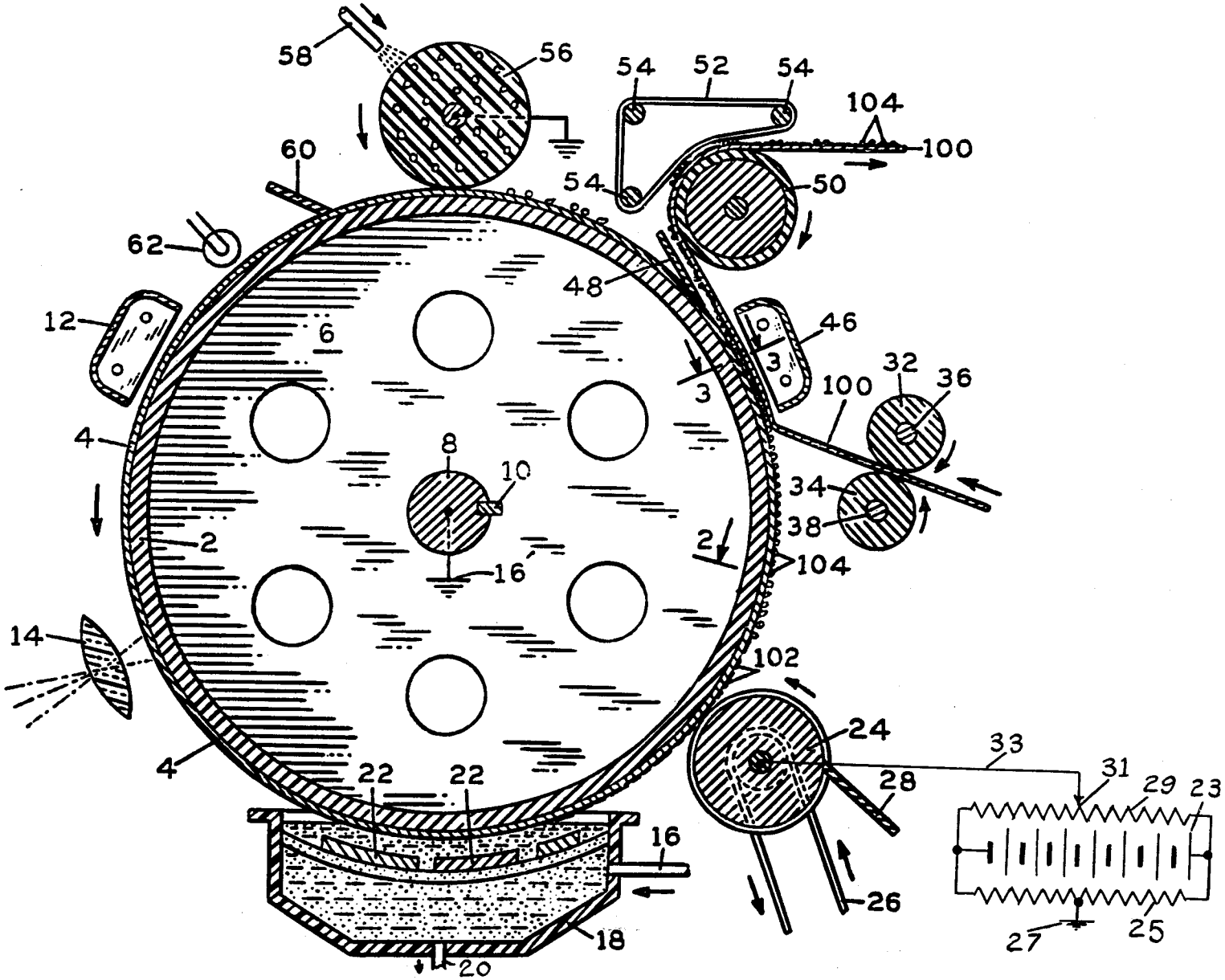
100
104
54
52
54
50
46
3
100
36
32
34
38
104
48
3
2
102
24
28
26
23
29
25
31
27
33
56
58
60
62
12
4
2
6
10
8
16
22
22
16
18
20
4
14

METHOD FOR DEVELOPING LATENT ELECTROSTATIC IMAGES FOR GAP TRANSFER TO A CARRIER SHEET

This is a division of application Ser. No. 267,465, filed May 27, 1981.

CROSS-REFERENCE TO RELATED APPLICATIONS

The present application is related to my application, Ser. No. 149,539, filed May 13, 1980, for "Improved Process and Apparatus for Transferring Developed Electrostatic Images to a Carrier Sheet, Improved Carrier Sheet for Use in the Process and Method of Making the Same", now U.S. Pat. No. 4,364,661, and to the application of Benzion Landa and E. Paul Charlap, Ser. No. 249,336, filed Mar. 31, 1981, for "Improved Method and Apparatus for Transferring Electrostatic Images to a Carrier Sheet" now U.S. Pat. No. 4,378,422. The present application is an improvement over my copending application, Ser. No. 250,720, filed Apr. 3, 1981, for "Composition for Developing Latent Electrostatic Images for Gap Transfer".

BACKGROUND OF THE INVENTION

In my copending application, Ser. No. 149,539, above-identified, the latent electrostatic image is developed by electrophoresis of toner particles through a liquid carrier which is a non-toxic, light, paraffinic hydrocarbon. The freshly developed moist image is then transferred across an air gap to a carrier sheet. In the prior art, part of the carrier liquid in the non-image areas will be absorbed by the carrier sheet and must be dried, usually by heat. This evaporates hydrocarbons into the circumambient atmosphere, and the amount of evaporation permitted is strictly controlled by law. This reduces the speed at which the electrophotographic copying machine can be operated. A non-toxic, light, paraffinic hydrocarbon carrier liquid, such as ISOPAR-G (trademark of Exxon Corporation), is one of the aliphatic hydrocarbon liquids which I use in my composition. The contacting of a carrier sheet with the freshly developed image will induce smudging, smearing, or squashing of the developed image. This reduces the resolution. Then too, the charge of the toner particles is opposite to the charge of the latent electrostatic image. This arrangement is such, in the prior art, that the paper tends to stick to the photoconductive, or insulating, surface on which the image is developed. This produces difficulty in removing the carrier sheet bearing the developed image from the photoconductive surface. The usual carrier sheet is paper, and repetitive contact of paper with a moist developed image leaves paper fibers on the photoconductive surface. Since all of the developed image is rarely transferred to the carrier sheet, the paper fibers contaminate the developing liquid.

I have found, as pointed out in the copending applications, above-identified, that these disadvantages can be avoided by spacing the carrier sheet from the photoconductor to form a gap and causing the freshly developed image to negotiate the gap between the photoconductor and the carrier sheet by placing a charge on the back of the carrier sheet by means of a corona or the like.

In my copending application, Ser. No. 149,539, I describe the method of transferring freshly liquid-developed images across a gap. I disclose methods of forming a gap by providing the carrier sheet with protuberances formed on the carrier sheet which prevent the contact of the major area of the carrier sheet with the freshly developed image by deforming the sheet or otherwise forming protuberances thereon. In the copending application of Benzion Landa and E. Paul Charlap, Ser. No. 249,336, there is disclosed another means of carrying out my method. We there provide spacing particles to form the desired gap between the substrate bearing the freshly developed electrostatic image by positioning them on the developed image or by forming spacing protuberances on the photoconductive, or insulating, surface on which the latent electrostatic image is formed.

I have discovered that I may accomplish substantially the same result by another means—namely, by disseminating spacer particles adapted to prevent the carrier sheet from contacting the freshly developed image in the developing composition of this invention so that these particles are spaced throughout the developed image and the background areas, thus forming the desired gap over which the transfer of the developed latent electrostatic image occurs.

In order to remove excess carrier liquid from the photoconductor so as to reduce the danger of wetting the carrier sheet to which the developed image is to be transferred, I use a reverse roller which shears the excess developing liquid from the surface of the photoconductor, after the image has been developed, without disturbing the developed image. This is described in Hayashi et al U.S. Pat. No. 3,907,423.

In order to prevent the removal of a large number of spacer particles from the surface of the photoconductor in the non-image areas where they are not held by the charge of the electrostatic image, I bias the reverse roller. This charge should be of the opposite polarity as the polarity of the charge on the toner particles, since this will reduce the deposition of toner on the background areas and prevent the background areas from being gray. If the spacer particles do not have a surface charge which is the same as the charge of the toner particles, the toner particles will tend to deposit on the spacer particles. This will produce black dots on the background areas where the spacer particles contact the carrier sheet. It will be appreciated that, to perform their function in spacing the carrier sheet from the surface of the photoconductor, the spacer particles are interposed between the surface of the photoconductor and the carrier sheet. Furthermore, if the spacer particles acquired a charge opposite to the charge of the toner particles, not only would black dots be created in the non-image areas, but the spacer particles would become covered with toner particles and settle to form a hard, non-dispersible mass.

FIELD OF THE INVENTION

The invention relates to an improved composition for developing latent electrostatic images by liquid toning, in which a gap is formed across which transfer takes place.

DESCRIPTION OF THE PRIOR ART

Machida, in U.S. Pat. No. 3,915,874, discloses a liquid developer for use in developing a latent electrostatic image and then transferring it to a carrier sheet by contact between the carrier sheet and the developed image in which resolution is increased by preventing crushing of the toner particles forming the developed image. He does this by suspending fine particles which are harder than the toner particles throughout the liquid carrier which is any of the known aliphatic hydrocarbon liquids used in dielectric liquid-carried toner particles forming developing liquids of the prior art. The fine anti-crushing particles employed by Machida are inorganic materials, such as glass beads, zinc oxide, titanium dioxide, silica, and the like. The average fine inorganic particles have a diameter of from 1μ to 15μ. Machida erects a signpost to the art against the instant invention by pointing out that, above a 15μ diameter of the hard, fine particles, there is an increase in white spots which destroy the image and the resolution. There is no disclosure of using spacer particles of such large size as to prevent contact between the carrier sheet and the developed image by forming a gap. The "white spots" mentioned by Machida are "holidays" in the transferred image. The "fine" particles of Machida are equal to or smaller in diameter than the toner particles, so that there is contact between the developed image and the carrier sheet to which the image is being transferred.

SUMMARY OF THE INVENTION

In general, my invention contemplates the provision of a carrier liquid comprising a low-boiling, aliphatic hydrocarbon, such as ISOPAR-G, as the liquid component of my composition. This is a narrow cut of isoparaffinic hydrocarbons having an initial boiling point of 319° F. and an end point of 345° F. It has a flash point about 100° F. I may use higher-boiling aliphatic hydrocarbon liquids, such as ISOPAR-M (trademark of Exxon Corporation), or light mineral oils, such as "Marcol 52" or "Marcol 62" (trademarks of Humble Oil & Refining Company). I disperse finely ground pigment particles which are charged. These charged particles are adapted to develop a latent electrostatic image by electrophoresis. I also disseminate larger spacer particles through the carrier liquid which act as gap-forming means to prevent the freshly developed image from contacting the carrier sheet, and which spacer particles form an air gap between the carrier sheet and the photoconductor. The size of the spacer particles is not greater than 70 microns. The spacer particles are made of a material having a dielectric constant greater than the dielectric constant of the carrier liquid, so that they may acquire internal polarization depending on the strength of the field into which they move. The dielectric constant of ISOPAR-G, for example, is 2.0. The dielectric constant of an acrylic resin, such as methyl methacrylate, lies between 3.0 and 3.5. The dielectric constant of cellulose acetate lies between 3.0 and 7.0. The dielectric constant of polyvinylchloride lies between 6.5 and 12. In order that the spacer particles may have a surface charge of the same polarity as the charge of the toner particles, I may add a charge director to the composition, which imparts a surface charge of the same polarity as the toner particles to the spacer particles, if such is not already the case.

The charged toner particles of my composition have a low charge to mass ratio, so that they will form a developed image which is less compact, or less cohesive, and relatively more fluffy than and thicker than the developed images of the prior art. This is a salient feature which no one has heretofore observed. The white spots, or holidays, in the transferred image observed by Machida when his "fine particles" reached a diameter above 15 microns, were caused in part by his compact or highly viscous developed image. No worker in the prior art taught a developing liquid composition capable of developing a latent electrostatic image transferable over a gap between the image and a carrier sheet. I achieve a low charge to mass ratio in the toner particles by making the average size of the toner particles larger than the toner particles customarily used in the prior art.

OBJECTS OF THE INVENTION

One object of my invention is to provide a developing composition comprising a carrier liquid, the use of which will reduce the quantity of carrier liquid which will be evaporated from a sheet to which a developed image is transferred.

Another object of my invention is to provide an improved developing liquid composition adapted to form an air gap between the surface bearing the developed electrostatic image and a carrier sheet to which the developed image is transferred.

Still another object of my invention is to provide a developing liquid composition in which an air gap is formed between a photoconductor bearing a developed electrostatic image and sheet material, which will prevent smearing, smudging, or squashing of the developed image in the course of its transfer from the photoconductor to the sheet material.

A further object of my invention is to provide a developing liquid composition in which a gray scale is generated during the development.

A still further object of my invention is to provide a developing liquid composition, by use of which a developed electrostatic image can be transferred from an insulating surface to rougher papers.

An additional object of my invention is to provide a developing liquid composition, by the employment of which a developed electrostatic image may be transferred to non-absorbent sheets, such as those made of cellulose nitrate, cellulose acetate, hydroxy-cellulose esters, or the like.

Another object of my invention is to provide a developing liquid in which thin lines are reproduced with greater density.

Still another object of my invention is to provide a developing liquid which will produce copies of an increased resolution on a carrier sheet.

A further object of my invention is to provide an improved developing liquid which will prevent the formation of black dots on the non-image areas.

A still further object of my invention is to provide a developing composition containing dielectrophoretic spacer particles which will survive a reverse metering roller—that is, a roller whose surface moves in a direction opposite to the direction of movement of the surface of the photoconductor bearing the developed image.

An additional object of my invention is to provide improved apparatus enabling the use of my composition.

A salient object of my invention is to provide an improved method whereby latent electrostatic images may be developed on a photoconductor from which they are transferred across a gap to a carrier sheet.

Other and further objects of my invention will appear from the following description.

BRIEF DESCRIPTION OF THE DRAWING

The accompanying drawing, which forms part of the instant specification and which is to be read in conjunction therewith, shows one form of apparatus for carrying out my invention.

DESCRIPTION OF THE PREFERRED EMBODIMENT

More particularly, referring now to the drawing, a metal drum 2 carries a photoconductor 4 and is mounted by disks 6 on a shaft 8 to which the disks are secured by a key 10 so that the assembly will rotate with the shaft 8. This shaft is driven in any appropriate manner (not shown) in the direction of the arrow past a corona discharge device 12 adapted to charge the surface of the photoconductor 4, it being understood that the assembly is in a lightproof housing (not shown). The image to be reproduced is focused by a lens 14 upon the charged photoconductor. Since the shaft 8 is grounded at 16' and the disks 6 are conductive, the areas struck by light will conduct the charge, or a portion thereof, to ground, thus forming a latent electrostatic image. A developing liquid, comprising an insulating carrier liquid and toner particles, is circulated from any suitable source (not shown) through pipe 16 into a development tray 18 from which it is drawn through pipe 20 for recirculation. Development electrodes 22, which may be appropriately biased as known to the art, assist in toning the latent electrostatic image as it passes it contact with the developing liquid. Charged toner particles, disseminated through the carrier liquid, pass by electrophoresis to the latent electrostatic image, it being understood that the charge of the particles is opposite in polarity to the charge on the photoconductor 4. If the photoconductor is selenium, the corona charge will be positive and the toner particles will be negatively charged. If the photoconductor is made of cadmium sulphide, the charge will be negative and the toner particles will carry a positive charge. The amount of liquid on the surface of the photoconductor is normally too great for transfer. Accordingly, a roller 24, whose surface moves in a direction opposite to the direction of movement of the surface of the photoconductor, is spaced from the surface of the photoconductor and is adapted to shear excess liquid from the developed image without disturbing the image. This roller is shown in Hayashi et al U.S. Pat. No. 3,907,423. It is driven by any appropriate means, such as by drive belt 26, and kept clean by a wiper blade 28. The drive belt 26 is driven by any appropriate speed-controllable means (not shown since such is known to the art).

A pair of register rolls 32 and 34 are adapted to feed the carrier sheet 100, which is to receive the developed image, toward the photoconductor. The register rolls 32 and 34 are mounted on axles 36 and 38 to which the register rolls are secured for rotation therewith. The axles are driven in synchronism so that there is no relative motion between the points of closest approach of the rolls 32 and 34 to each other. If desired, only one of the register rolls need be driven. The register rolls are adapted to feed the carrier sheet 100, which is to receive the developed image, to the transfer station. The corona discharge device 46 is adapted to impress a charge upon the rear of the carrier sheet 100 of a polarity opposite to the polarity of the toner particles forming the developing image so as to draw the developed image toward the carrier sheet. A pick-off member 48 assists in the removal of the carrier sheet bearing the developed image from the photoconductor. A roller 50, coacting with a plurality of flexible bands 52, delivers the carrier sheet to an exit tray (not shown). The flexible bands are mounted on a plurality of rollers 54. A cleaning roller 56, formed of any appropriate synthetic resin, is driven in a direction opposite to the direction of rotation of the photoconductor to scrub the surface of the photoconductor clean. To assist in this action, developing liquid may be fed through pipe 58 to the surface of the cleaning roller 56. A wiper blade 60 completes the cleaning of the photoconductive surface. Any residual charge left on the photoconductive drum is extinguished by flooding the photoconductor with light from lamp 62.

The preferred embodiment of my invention contemplates the use of a low-boiling aliphatic hydrocarbon liquid such as pointed out above. These liquids are good insulators, having a resistivity of $10^{10}$ ohm-centimeters or greater. The developing liquids of the prior art have pigmented particles of colloidal size suspended in the developing liquid. These particles may be charged in the process of preparing them or they may be charged with a charge director which gives them the desired polarity. While the prior art specifies that the toner particles may vary in size, the charge to mass ratio is always high. In preparing my liquid developing composition, I use any of the pigmented particles of the prior art, but ensure that there is a low charge to mass ratio. I accomplish this by using toner particles of larger size, of a magnitude in the order of 3 to 7 microns. I have observed that a low charge to mass ratio enables the toner particles to form flocs, or clumps, which are loosely associated but are readily disassociated when the developing liquid is agitated. These flocs are amorphous units which are formed by loosely associated toner particles and range in size in the order of from 8 microns to as high as 20 microns. I have found it very difficult to ascertain the size of the desired flocs, especially during their behavior in the presence of an electrostatic field. Optical microscopy does not lend itself to viewing electrophotographically developed images. In most systems for developing latent electrostatic images, the toner is agitated by pumping it from a supply to a developing zone and back to a supply. This agitation will keep the toner particles disseminated throughout the carrier liquid. The loose flocculation of toner particles which I observe indicates that there is a low charge to mass ratio, which is a necessary element to my invention. If a toner comprising a dielectric liquid and large toner particles with a low charge to mass ratio is used to develop a latent electrostatic image, the developed image will be less cohesive, less dense, and of lower viscosity than the images developed with toners of the prior art with which I have had any experience. The production of a less cohesive or fluffier toned image is one of the features which enables me to achieve the objects of my invention with that degree of excellence I desire. That is not to say that my invention cannot be practiced less efficiently as the cohesion of the developed image is increased. In photocopying machines, means are provided for reducing the quantity of developing liquid on the developed image. This may be done by metering means such as a reverse roller. The quantity of toner particles which I employ may vary from between 0.1 percent to 10 percent by weight in respect of the carrier liquid. This contrasts with the usual range of toner concentration of approximately 0.1 percent to 2 percent of toner particles by weight in respect of the carrier liquid. If the development is slow, the lower level of concentration of toner can be used, but the upper limit of 2 percent cannot ordinarily be exceeded without producing discoloration of the background areas. In my process, I am enabled to employ as high as 10 percent by weight of toner particles in respect of the carrier liquid, since my image is transferred across an air gap and there will be no discoloration of the background areas. This enables a copying machine using the developing composition of my invention to be operated at a much higher speed.

After I have determined the suitable toner-particle size in the specific liquid carrier, and with due consideration of the composition of the toner particles so as to form readily disassociated flocs, I am ready to supply the liquid with spacing particles, the function of which is to form a gap between the developed image and the carrier sheet to which the image is to be transferred. I measure this gap from between the insulating surface carrying the image to the surface to which the image is to be transferred, since this gap is readily determined by the spacing particles. The maximum thickness of a developed image is usually less than 20 microns, so that there is a gap between the surface of the image and the surface of the sheet which is to receive the transferred image. The spacing particles may vary in diameter between 20 microns and 70 microns, with the preferred size being between 30 microns and 40 microns. This ensures that there will be an air gap between the top of the developed image and the carrier sheet to which the image is to be transferred.

I next determine the concentration of the spacing particles within the carrier liquid. I do this empirically by successively adding amounts of spacing particles to the carrier liquid and observing the interparticle spacing on the photoconductor. This distance should be less than four millimeters. The spacing particles may be made of any appropriate material which is insoluble in the carrier liquid and which has a dielectric constant higher than the dielectric constant of the carrier liquid. Typical materials are synthetic resins, such as polyacrylates, methyl methacrylate, polyvinylchloride, polycarbonate, polyamides and the like as well as natural polymers such as sago starch. Typical carrier liquids are of the liquid isoparaffinic hydrocarbons, all of which have a dielectric constant in the vicinity of 2.

The spacing particles should have the following characteristics:

(a) They must have a comparatively low specific gravity so they do not settle out too rapidly.

(b) They must exhibit dielectrophoresis; that is, they must have a dielectric constant higher than that of the carrier liquid.

(c) They must have good surface conductivity to inhibit transfer to the carrier sheet.

(d) The surface charge should have the same polarity as the charge of the toner particles.

(e) The size of the spacer particles should be seventy microns or less.

(f) The spacer particles should have a shape which will enable them to resist the shear forces of the metering means, such as a squeegee absorbing roller, reverse roller or the like.

The high dielectric constant enables the spacer particles to assume an induced charge or polarization due to the applied field when it is positioned between the photoconductor and the metering means. At the same time, the spacer particles must assume a surface charge of the same polarity as the charge of the toner particles.

The image areas tend to trap spacer particles to a greater degree than the non-image areas. I have found that the preferred shape of the spacing particles, from an abrasion point of view, is spherical, since these particles will tend to roll or flow more readily and therefore tend to scratch the photoconductor less than other shapes. Hard crystalline materials are highly abrasive and rapidly abrade the sensitive surface of the photoconductor. The spacing particles must survive the metering station.

The quantity of spacing particles may vary from as little as 0.1 percent by volume to 10 percent by volume in respect of the carrier liquid. It will be clear to those skilled in the art that the specific gravity of most of the materials from which the spacing particles are made is larger than the specific gravity of the carrier liquid and will tend to settle out rapidly. The actual percentage of spacing particles in circulation at one time is difficult to determine, except by the empirical method I have pointed out above. Most systems draw liquid from the bottom of a sump, and the spacing particles tend to drift rapidly toward this bottom. The concentration of spacing particles, which I have determined empirally, will always produce an interparticle distance of less than 4 millimeters in the non-image areas.

In order to prevent the deposition of toner particles on the spacer particles, I may add a charge director to impart a surface charge to the spacer particles of the same polarity as the charge on the toner particles. This prevents the spacer particles from being covered with toner particles, which would create black dots. If the photoconductor whose selenium or selenium-tellurium, it would be charged with a positive corona and the toner particles would bear a negative charge. If the photoconductor were cadmium sulphide, or the like, the corona would be negative and the toner particles and the spacer particles would be positively charged. If the photoconductor were amorphous silicon, it could be doped either positive or negative—as is the case, of course, with poly-N-vinyl carbazole and its derivatives, which can be doped either positive or negative as desired.

Suitable negative charge directors are linseed oil, calcium petroleum sulphonate (manufactured by WITCO Corporation of Canada), alkyl succinimide (manufactured by Chevron Chemical Company of California). Positive charge directors are sodium dioctyesulfo-succinate (manufactured by American Cyanimide and Chemical Corp), zirconium octoate, and metal soaps such as copper oleate.

Referring again to the drawing, a source of potential such as a battery 23 is provided with a bridge circuit, including a fixed resistor 25 which is grounded at its midpoint at ground 27, and a resistor 29 adapted to be engaged by a brush 31 which is connected to the reverse roller 24 by conductor 13. In this way, I am enabled to place the desired bias on the reverse roller 24.

The spacer particles which I employ have a higher dielectric constant than that of the carrier liquid. Since the phenomenon of dielectrophoresis is that a particle with a higher dielectric constant than the carrier liquid will migrate in the direction of the higher field intensity, the spacer particles will be attracted to the background areas of the electrostatic image. I move the brush 31 so as to impress a charge on the reverse roller 24 which is of opposite polarity to the polarity of the toner particles. This will attract toner particles in the background areas to the reverse roller and keep the background areas from becoming gray or dingy with toner. At the same time, the spacer particles will migrate toward the photoconductor. Accordingly, this will keep a large population of spacer particles out of the high shear area of the reverse roller and permit the spacer particles to remain on the photocondutor while at the same time permitting toner particles to go to the bias metering means and thus keep the background areas free of toner particles.

It will be seen that I have accomplished the objects of my invention. I have imparted a surface charge to the spacer particles of the same polarity as the charge on the toner particles. This avoids two deleterious effects. It prevents the spacer particles from being covered by the toner particles and thus avoids the creation of black dots on the non-image areas of the transferred image. Furthermore, it prevents the formation of hard, non-dispersible masses. I charge the reverse roller or other metering means with a polarity which is the same as the polarity of the latent image, that is, opposite in polarity to the polarity of the toner particles. Owing to the fact that my spacer particles have a dielectric constant hgher than the dielectric constant of the carrier liquid, they will by dielectrophoresis migrate towards the photoconductor. Accordingly, while the surface charge of the spacer particles tends to move them in the direction of the reverse roller, dielectrophoresis, being more powerful, will prevent them from doing so. My composition reduces the amount of carrier liquid which will be transferred to the sheet material and hence evaporated therefrom after the image has been transferred. The transfer of the developed image across a gap prevents smearing, smudging, or squashing of the developed image and enables me to produce a denser image than heretofore possible with liquid-developed images. By ensuring that a large majority of spacer particles survive the shear effect of the reverse roller, I am enabled to achieve a separation of the non-image areas on the photoconductor from the carrier sheet. I have provided apparatus capable of employing my improved composition for developing latent electrostatic images.

It will be understood that certain features and subcombinations are of utility and may be employed without reference to other features and subcombinations. This is contemplated by and is within the scope of my claims. It is further obvious that various changes may be made in details within the scope of my claims without departing from the spirit of my invention. It is, therefore, to be understood that my invention is not to be limited to the specific details shown and described.

Having thus described my invention, what I claim is:

1. A method of developing a latent electrostatic image comprising the steps of subjecting the latent image to the action of a developing composition; a metering step and a transfer step in succession; said developing composition comprising dielectric spacer particles and charged toner particles disseminated throughout a dielectric carrier liquid, said spacer particles having a higher dielectric constant than said carrier liquid; said metering step including the step of biasing a metering means to a polarity opposite to the polarity of the charge of said toner particles; said transfer step including spacing a carrier sheet from the developed electrostatic image by said spacer particles and then applying a potential to the back of said carrier sheet of a polarity opposite to the polarity of said toner particles.

* * * * *